US006585503B2

(12) United States Patent
Okada et al.

(10) Patent No.: US 6,585,503 B2
(45) Date of Patent: Jul. 1, 2003

(54) SCREW COMPRESSOR HAVING A SHAPED DISCHARGE PORT

(75) Inventors: Hiroshi Okada, Anjo (JP); Sota Shibasaki, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/983,108

(22) Filed: Oct. 23, 2001

(65) Prior Publication Data

US 2002/0051722 A1 May 2, 2002

(30) Foreign Application Priority Data

Oct. 30, 2000 (JP) ..... 2000-330537
Aug. 24, 2001 (JP) ..... 2001-254689

(51) Int. Cl.[7] ..... F04C 18/16
(52) U.S. Cl. ..... 418/201.1
(58) Field of Search ..... 418/201.1

(56) References Cited

U.S. PATENT DOCUMENTS 2,474,653 A * 6/1949 Boestad ..... 418/201.1
2,480,818 A * 8/1949 Whitfield ..... 418/201.1
5,051,077 A 9/1991 Yanagisawa et al. .... 418/201.1

FOREIGN PATENT DOCUMENTS

JP 3-15689 * 1/1991 ..... 418/201.1
JP U-4-42286 4/1992
JP A-6-323269 11/1994
JP A-8-338386 12/1996
JP A-8-338387 12/1996

* cited by examiner

*Primary Examiner*—John J. Vrablik

(57) ABSTRACT

Pulsation, vibration and noise of a screw compressor is caused by compressed air abruptly discharging through a discharge port in a rotor chamber during rotation of a pair of rotors. The inside opening shape of the discharge port is within two tip curved lines drawn by the pair of rotors and coincides with the two tip curved lines at least at one point when fluid starts to discharge. In one embodiment, the inside opening shape is triangular with a vertex at a point of intersection of the two tip curved lines and a base side along the discharge end face of the rotor chamber. With this, when the air compressed in the compression chamber discharges from the discharge port, the discharge opening area of the discharge port smoothly increases. This reduces the pulsation of the discharged air and thus reduces the vibration and noise of the screw compressor.

7 Claims, 10 Drawing Sheets

SCREW COMPRESSOR HAVING A SHAPED DISCHARGE PORT

CROSS REFERENCE TO RELATED APPLICATION

This application is based on an incorporates herein by reference Japanese Patent application No. 2000-330537 filed on Oct. 30, 2000, and Japanese Patent Application No. 2001-254689 filed on Aug. 24, 2001.

BACKGROUND OF THE INVENTION

1. Field of the Invention

The present invention relates to a screw compressor for compressing fluid by the rotation of a pair of rotors (a male rotor and a female rotor) which are engaged with each other and, in particular, to the discharge port of the fluid.

2. Description of the Related Art

A casing for receiving a pair of rotors of a screw compressor has a discharge port through which fluid compressed by the rotation of the rotors is discharged to the outside of a rotor chamber.

The fluid discharged from the discharge port is pulsated with a pressure difference between a compression chamber and a discharge space to cause the vibrations and noises of an air compressor when the fluid is discharged.

A technology disclosed in Japanese Unexamined Patent Publication No. 6-323269 is a technology for reducing vibration and noise of an air compressor. According to this technology, an abrupt increase in the opening area of the discharge port can be reduced by providing a time difference between the instant when a discharge port in a radial direction begins to open and the instant when a discharge port in an axial direction begins to open.

In the technology disclosed in the above patent gazette, however, the opening area of the discharge port is increased suddenly at the instant when the discharge port in a radial direction starts to open and the instant when the discharge port in an axial direction starts to open, so an effect of reducing the pulsation of the fluid is reduced.

SUMMARY OF THE INVENTION

The present invention has been made in view of the above problems. Thus, it is an objective of the present invention to provide a screw compressor capable of reducing the pulsation of discharged fluid thereby reducing vibration and noise by smoothly and steadily increasing the discharge opening area of the discharge port. It is a second object of the present invention to provide a screw compressor which will reduce a decrease in pressure just after fluid starts to discharge and reduce an increase in pressure thereafter to further reduce the pulsation caused by the discharging fluid.

To achieve the objective of the present invention, there is provided a screw compressor. The opening shape of a discharge port in a rotor chamber is inside two tip curved lines and coincides with the two tip curved lines at one common point. When fluid compressed in a compression chamber is discharged from the discharge port, an area of the discharge port communicating with the compression chamber gradually increases from the point where the compression chamber coincides with the discharge port. In other words, when the fluid compressed in the compression chamber is discharged from the discharge port, the discharge opening area of the discharge port smoothly increases. This reduces the pulsation of the discharged fluid and thus the vibration and noise generated by the screw compressor.

The opening area of the discharge port in the rotor chamber may be formed in a polygonal shape having a vertex on at least one tip curved line of the two tip curved lines (or point of intersection of the two tipped curved lines) and one side of the discharge side end face of the rotor chamber. Alternatively, the opening shape of the discharge port in the rotor chamber may be formed in a triangular shape having a vertex at a point of intersection of the two tip curved lines and one side on the discharge side end face of the rotor chamber.

The opening shape of the discharge port in the rotor chamber may have a vertex at a point of intersection of the two tip curved lines and may be formed in such a way that the distance between points where the two tip curved lines intersect an imaginary plane perpendicular to the rotating shafts of the rotors increases as the imaginary plane comes near to the discharge end face of the rotor chamber. The opening shape of the discharge port in the rotor chamber may have a vertex at a point of intersection of the two tip curved lines and may be formed in such a way that the rate of change in the distance between points where the two tip curved lines intersect an imaginary plane perpendicular to the rotating shafts of the rotors increases as the imaginary plane comes near to the discharge end face of the rotor chamber. Additionally, the opening area of the discharge port in the rotor chamber may be set at 65% or less of an area surrounded by the two tip curved lines and the discharge side end face of the rotor chamber.

The rate of change may be decreased from certain portions near the discharge side end face of the rotor chamber. In this case, the portions where the rate of change is decreased are provided at the regions of 70% to 80% of the distance of movement in the axial direction of the two tip curved lines between the instant when the fluid starts discharging from the discharge port and the instant when the fluid finishes discharging.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DESCRIPTION OF THE EXEMPLARY EMBODIMENTS

Embodiment s in accordance with the present invention will be described with reference to the first and second exemplary embodiments and additional exemplary embodiments.

Figure 1:
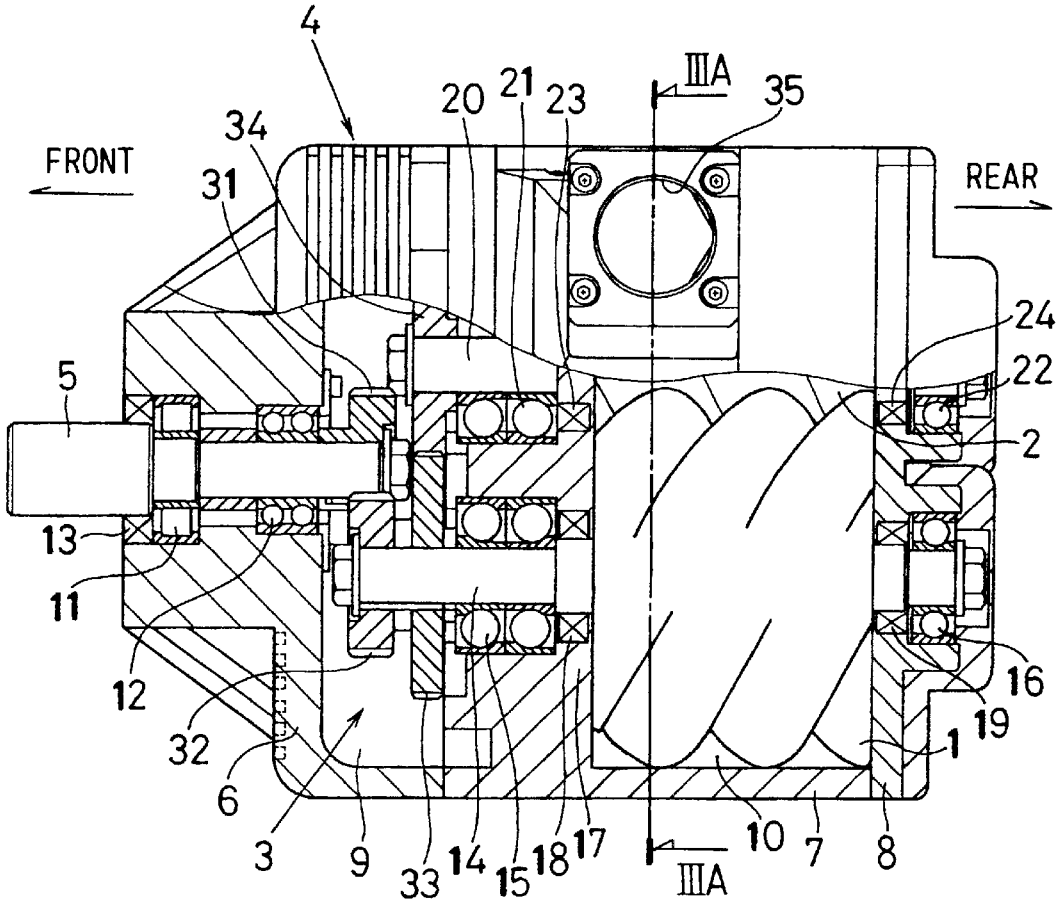
FIG. 1 is a cross-sectional side view of a screw compressor of a first exemplary embodiment in accordance with the present invention.
Figure 2:
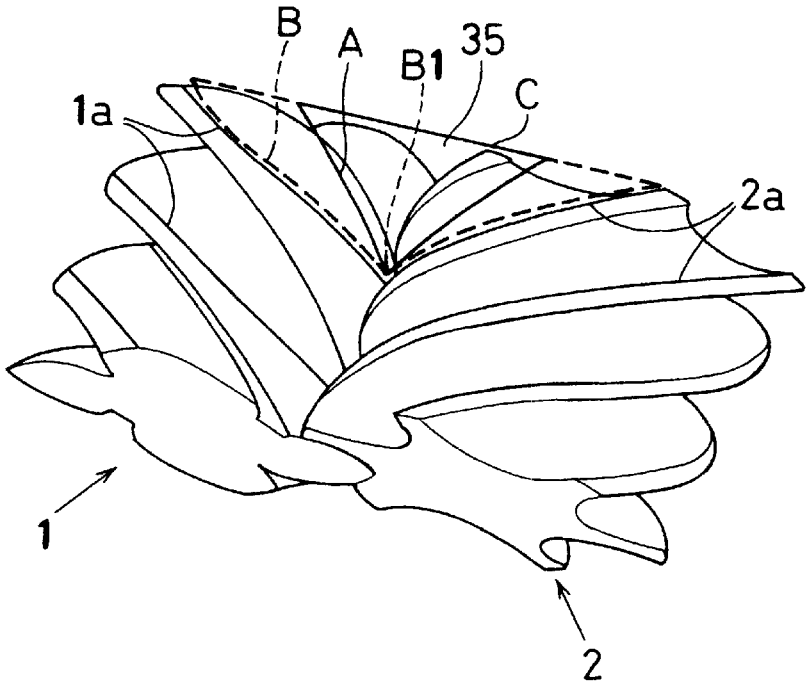
FIG. 2 is a perspective view showing a main portion of a pair of rotors of a first exemplary embodiment in accordance with the present invention.
Figure 3:
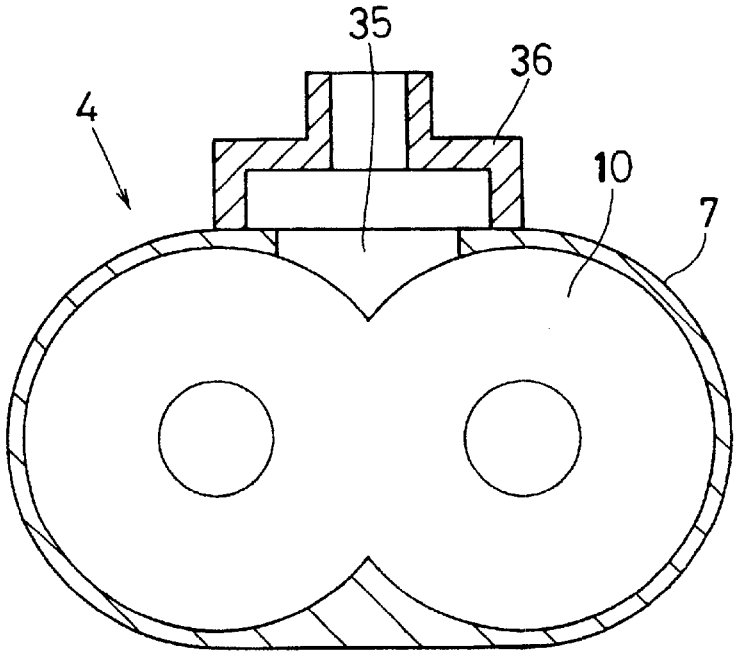
FIG. 3 is a cross-sectional view of a casing taken along line IIIA—IIIA in FIG. 1.

The first exemplary embodiment will be described with reference to FIG. 1 to FIG. 9. Here, FIG. 1 to FIG. 3 are views showing a screw compressor. FIG. 1 is a cross-sectional side view of a screw compressor. FIG. 2 is a perspective view showing a main portion of a pair of rotors. FIG. 3 is a cross-sectional view of a casing taken along line IIIA—IIIA in FIG. 1. In this first exemplary embodiment, for the sake of easy understanding of the description, it is noted that the left side in FIG. 1 is a front side and that the right side is a rear side.

A screw compressor has a male rotor 1 and a female rotor 2 which are engaged with each other (hereinafter referred to as a pair of rotors 1, 2), a gear mechanism 3 for driving the pair of rotors 1, 2, and a casing 4 for separately receiving the pair of rotors 1, 2 and the gear mechanism 3.

This casing 4 is formed of three combined parts of, from the left side (input shaft 5 side) to the right side in FIG. 1, a front case 6, a main case 7, and a rear case 8. A gear chamber 9, for receiving the gear mechanism 3, is formed in a space surrounded by the front case 6 and the main case 7 and a rotor chamber 10 for receiving the pair of rotors 1, 2 is formed in a space surrounded by the main case 7 and the rear case 8. Here, the gear chamber 9 is filled with lubricating oil.

The front case 6 supports the input shaft 5 via the first and second bearings 11, 12, which are disposed on the front and rear portions of the input shaft 5, respectively. A first oil seal 13 is provided for preventing oil supplied to the first and second bearings 11, 12 from flowing outside the main case 7 and is provided at the front end of a hole through which the input shaft 5 passes.

A male rotor rotating shaft 14 is supported at one end by the main case 7 via the third bearing 15 and at the other end by the rear case 8 via the fourth bearing 16. A partition wall 17 for partitioning the gear chamber 9 from the rotor chamber 10 is provided with the second oil seal 18 for preventing oil supplied to the third bearing 15 from leaking into the rotor chamber 10 through a hole through which the male rotor rotating shaft 14 passes. Further, the hole which is made in the rear case 8 and through which the male rotor rotating shaft 14 is passed is provided with the third oil seal 19 for preventing the grease sealed in the fourth bearing 16 from leaking into the rotor chamber 10.

A female rotor rotating shaft 20, as is the case with the above-mentioned male rotor rotating shaft 14, is supported at one end by the main case 7 via the fifth bearing 21 and at the other end by the rear case 8 via the sixth bearing 22. A partition wall 17 for partitioning the gear chamber 9 from the rotor chamber 10 is provided with the fourth oil seal 23 for preventing oil supplied to the fifth bearing 21 from leaking into the rotor chamber 10 through a hole through which the female rotor rotating shaft 20 is passed. Further, the hole which is made in the rear case 8 and through which the female rotor rotating shaft 20 is passed is provided with the fifth oil seal 24 for preventing the grease sealed in the sixth bearing 22 from leaking into the rotor chamber 10.

The gear mechanism 3 transmits the rotation of the input shaft 5 to the male rotor rotating shaft 14 and the female rotor rotating shaft 20 to rotate the pair of rotors 1, 2 in synchronization with each other. The gear mechanism 3 also has the first and second gears 31, 32 for transmitting the rotation of the input shaft 5 to the male rotor rotating shaft 14, and the third and fourth gears 33, 34 for transmitting the rotation transmitted to the male rotor rotating shaft 14 from the second gear 32 to the female rotor rotating shaft 20. In this respect, the third and fourth gears 33, 34 are timing gears for rotating the pair of rotors 1, 2 in synchronization with each other.

The pair of rotors 1, 2 engaged with each other have the shape shown in FIG. 2 and are synchronously rotated in the rotor chamber 10. Then, fluid (which will be hereinafter described as air in the present exemplary embodiment) is sucked from a suction port (not shown) made in the rear portion of the casing 4. The sucked air is compressed in a compression chamber constituted by the pair of rotors 1, 2 and the rotor chamber 10. The compressed air is moved with the rotation of the pair of rotors 1, 2 from the rear portion to the front portion of the rotor chamber 10. When the rotational angle of the pair of rotors 1, 2 reaches a predetermined angle and the volume of the compression chamber reaches a design value, the compression chamber opens a discharge port made in the discharge side of the casing 4 (front side of the rotor chamber 10). As a result, the air compressed to a high pressure in the compression chamber is discharged from the discharge port 35 to the outside of the screw compressor through the discharge opening 36.

The opening shape of the discharge port 35 in the rotor chamber 10 will now be described. The opening shape of the discharge port 35 in the rotor chamber 10, as shown by a solid line A in FIG. 2 (hereinafter referred to as an inside opening shape A because it is the opening shape inside the rotor chamber 10), is inside two tip curves B drawn (defined) by the tips 1*a*, 2*a* of the pair of rotors 1, 2 and coincides with the two tip curves B at least at one point when the fluid starts to discharge. As shown in FIG. 3 the cross-section of the discharge port 35 in the main case 7 is unchanged in the discharge direction.

Figure 4A:
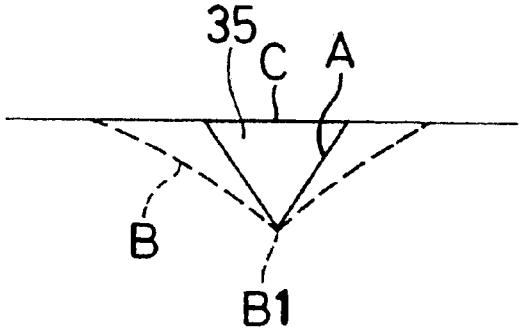
FIG. 4A is an illustration showing the shape of the discharge port of the first exemplary embodiment in accordance with the present invention.
Figure 4B:
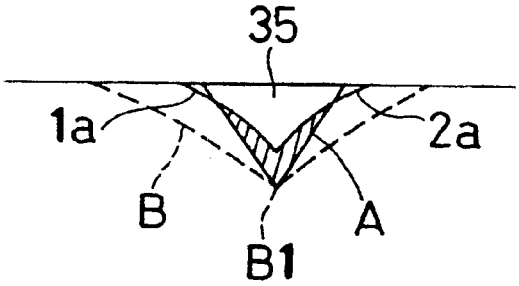
FIG. 4B is an illustration showing the shape of the discharge port of the first exemplary embodiment in accordance with the present invention.
Figure 4C:
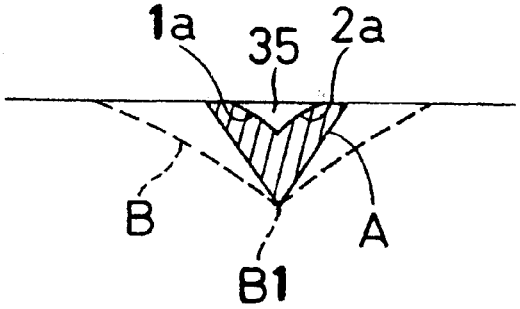
FIG. 4C is an illustration showing the shape of the discharge port of the first exemplary embodiment in accordance with the present invention.

An inside opening shape A in the present exemplary embodiment is shown in FIG. 4A to FIG. 4C. The inside opening shape A in the present exemplary embodiment is formed in a triangular shape having a vertex at an intersection point intersection, B1, of the two tip curved lines B and a base side on a side C along the discharge side end face of the rotor chamber 10. In this manner, the distance between the points where the two tip curved lines intersect an imaginary plane perpendicular to the respective rotating shafts 14, 20 increases as the imaginary plane comes close to the discharge side end face of the rotor chamber 10. In other words, when the air compressed in the compression chamber is discharged, the discharge opening area of the discharge port 35 increases smoothly from one point. This reduces the pulsation of the discharged air and thus reduces the vibration and noise of the screw compressor.

Next, with reference to FIG. 4A to FIG. 4C, there will be described the state where the opening area of the discharge port 35 is varied over time. At the very instant when the rotational angle of the pair of rotors 1, 2 reaches a predetermined angle and the discharge port 35 starts opening, as shown in FIG. 4A, the opening area (the hatched portion) is non-existent. When the rotors 1, 2 are rotated and time t1 (for example, 0.4 seconds) elapses from the time when the air starts to discharge, the opening area is varied to the state shown in FIG. 4B to slightly open the discharge port 35, as shown by the hatching. When the rotors 1, 2 are further rotated and time t2 (for example, an additional 0.4 seconds) elapses, as shown in FIG. 4C, the opening area shown by hatching gradually increases. In this connection, the solid lines 1*a*, 2*a* in FIGS. 4B an 4C, designate the curved lines, moving with time, of the tips of the pair of rotors 1, 2, and move toward the discharge side end face of the rotor chamber 10.

Figure 5:
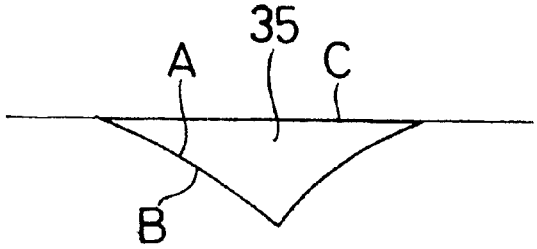
FIG. 5 PRIOR ART
FIG. 5 is an illustration showing the shape of a discharge port of a conventional embodiment.

Here, the inside opening shape A of a conventional discharge port 35 will be described. In the conventional discharge port 35, as shown in FIG. 5, the inside opening shape A agrees with the two tip curved lines B. Therefore, when the discharge port 35 is opened, the opening area is abruptly increased to produce pulsation by a discharge pressure.

Next, a modification of the inside opening shape A in the first exemplary embodiment will be described with reference to FIG. 6A to FIG. 6E. In the inside opening shape A shown in FIG. 6A, the rate of change in width increases as the position of the width comes near to the discharge end side. In other words, the inside opening shape A is formed in such a way that it has a point of intersection B1 of the two tip curved lines as a vertex and that the rate of change in the distance between the points where the two tip curved lines B intersect an imaginary plane perpendicular to the respective rotating shafts 14, 20 increases as the points come close to the discharge side end face of the rotor chamber 10. Thus, this configuration smoothly increases the opening area.

Figure 6A:
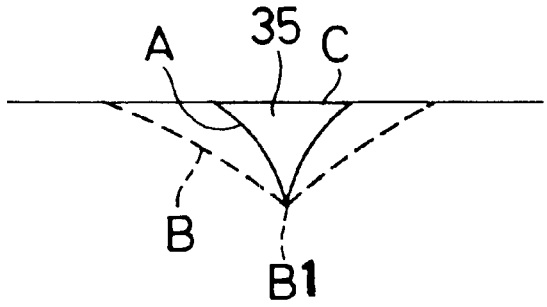
FIG. 6A is an illustration showing a shape of a discharge port in a modification of the first exemplary embodiment in accordance with the present invention.
Figure 6B:
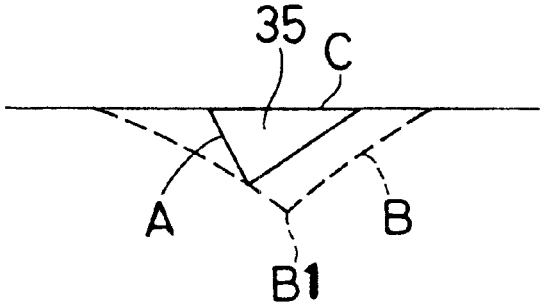
FIG. 6B is an illustration showing a shape of a discharge port in a modification of the first exemplary embodiment in accordance with the present invention.

The inside opening shape A shown in FIG. 6B is formed in the shape of a triangle. A vertex at the side where the discharge port starts opening is disposed on one curved line of the two tip curved lines B. This configuration produces a delay in discharging air just after the discharge port starts to open. This delay enhances the effect of preventing the pulsation of the discharged air.

Figure 6C:
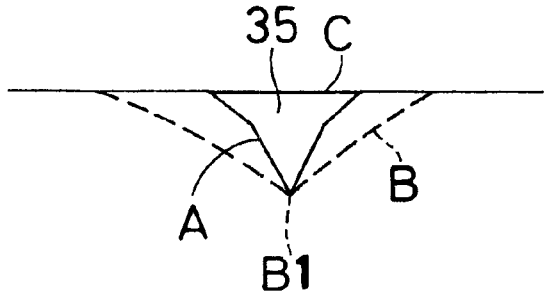
FIG. 6C is an illustration showing a shape of a discharge port in a modification of the first exemplary embodiment in accordance with the present invention.

The inside opening shape A shown in FIG. 6C is made by imitating the inside opening shape A shown in the first modification by a polygonal shape. In this manner, the inside opening shape A formed by the curved lines in the first modification is formed by straight lines. Therefore, this opening shape A can be easily made thereby reducing costs.

Figure 6D:
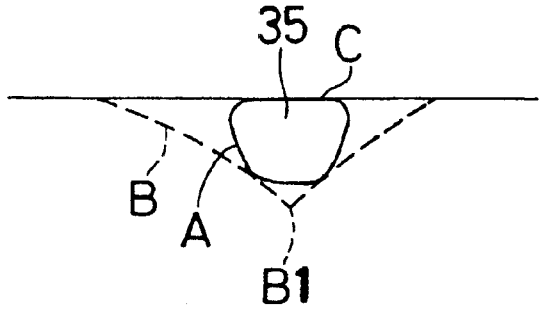
FIG. 6D is an illustration showing a shape of a discharge port in a modification of the first exemplary embodiment in accordance with the present invention.

The inside opening shape A shown in FIG. 6D is made by connecting the sharp corners of the inside opening shape A, shown in the embodiment of FIG. 4, with curved lines. By reducing the sharp corners in this manner, it is possible to reduce the pressure loss of the air discharged from the discharge port 35.

Figure 6E:
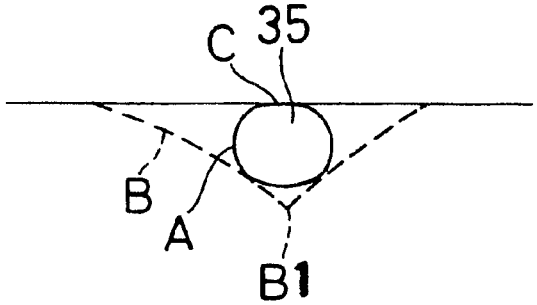
FIG. 6E is an illustration showing a shape of a discharge port in a modification of the first exemplary embodiment in accordance with the present invention.

The inside opening shape A shown in FIG. 6E is formed in the shape of a circle that contacts the two tip curved lines B and the side C along the discharge side end face. By forming the discharge port 35 in the shape of a circle in this manner, it is possible to reduce a pressure loss of the air discharged from the discharge port 35 as much as possible.

Figure 7:
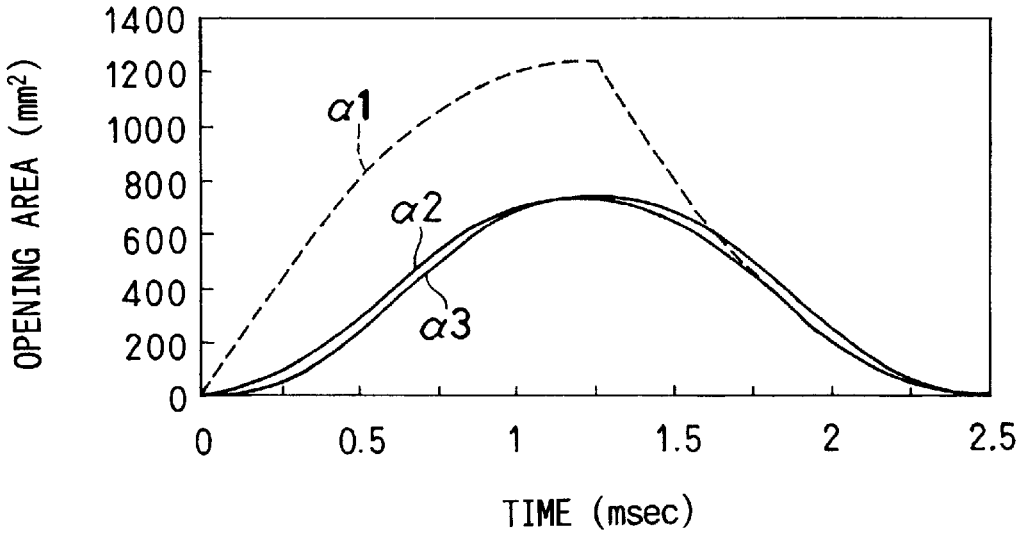
FIG. 7 is a graph showing the relationship between a lapse of time and an opening area a discharge port from the beginning of the opening of the discharge port to the end of discharge in the case where the discharge port shape is varied in a first exemplary embodiment in accordance with the present invention.

Next, a change in the opening area of the discharge port 35 during an elapse of time from the beginning of the opening of the discharge port 35 to the end of discharging will be shown in FIG. 7. In FIG. 7, a dashed line α1 shows a change in the opening area in the conventional discharge port 35 (see FIG. 5), and a solid line α2 shows a change in the opening area in the embodiment of FIG. 4, and a solid line α3 shows a change in the opening area in a first modification (see FIG. 6A). As shown in FIG. 7, it is apparent that a change in the opening area is smoother in the solid lines α2, α3 to which the present invention is applied as compared with the conventional methodology shown by dashed line α1. This smooth change in the opening area reduces the pulsation of the discharged air.

Figure 8:
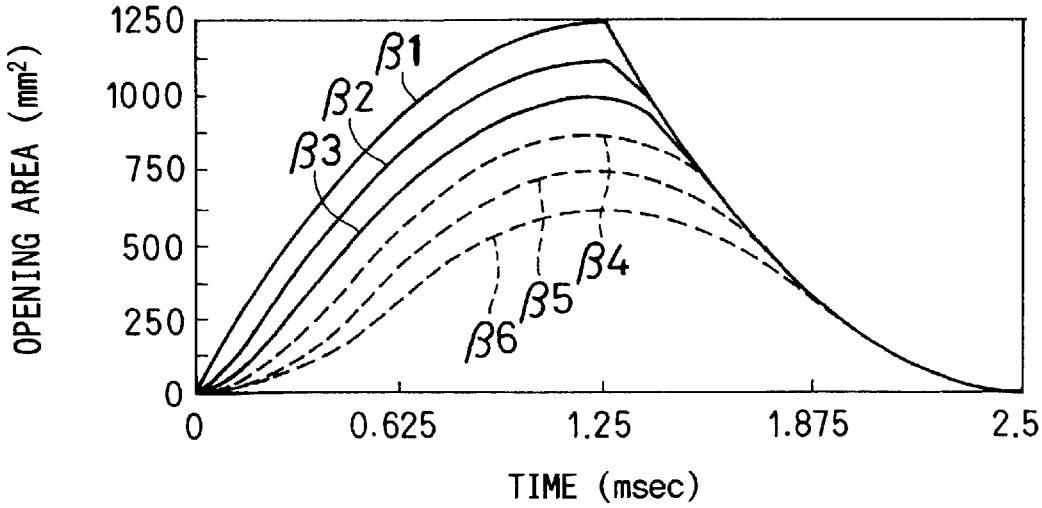
FIG. 8 is a graph showing the relationship between a lapse of time and an opening area of a discharge port from the beginning of the opening of the discharge port to the end of discharge in the case where the shape of the discharge port is varied in a first exemplary embodiment in accordance with the present invention.

Next, an opening area ratio of the discharge port 35 (which is a ratio of an area inside the two tip curved lines B to the inside opening shape A) will be described with reference to FIG. 8 and FIG. 9. FIG. 8 shows the relationship between a change in the opening area of the discharge port 35 and a change in an opening area ratio. A solid line β1 in FIG. 8 shows a change in the opening area in the conventional discharge port 35 (see FIG. 5). That is, the opening area ratio of the conventional discharge port 35 is 100%, which means that the opening area of the discharge port 35 is equal to the area inside the two tip curved lines B of FIG. 5.

Further, the discharge port 35 designated by a solid line β2 or later in FIG. 8 are made by varying the opening area ratio of the triangular shape shown in the above-mentioned exemplary embodiment. That is, a solid line β2 shows the case where the area of the discharge port 35 is 90% of the area inside the two tip curved lines B; a solid line β3 shows the case where the area of the discharge port 35 is 80% of the area inside the two tip curved lines B; a dashed line β4 shows the case where the area of the discharge port 35 is 70% of the area inside the two tip curved lines B; a dashed line β5 shows the case where the area of the discharge port 35 is 60% of the area inside the two tip curved lines B; and a dashed line β6 shows the case where the area of the discharge port 35 is 50% of the area inside the two tip curved lines B. In other words, the ratio of the opening area of the discharge port 35 to the area inside the two tip curved lines B (an area ratio of the discharge port 35 to the area inside the two tip curved lines B) is 1 for β1, 0.9 for β2, 0.8 for β3, 0.7 for β4, 0.6 for β5, 0.5 for β6.

As shown in FIG. 8, it is clear that as the area ratio decreases, the change in the opening area becomes smoother. This smooth change in the opening area can reduce the pulsation of the discharged air.

Figure 9:
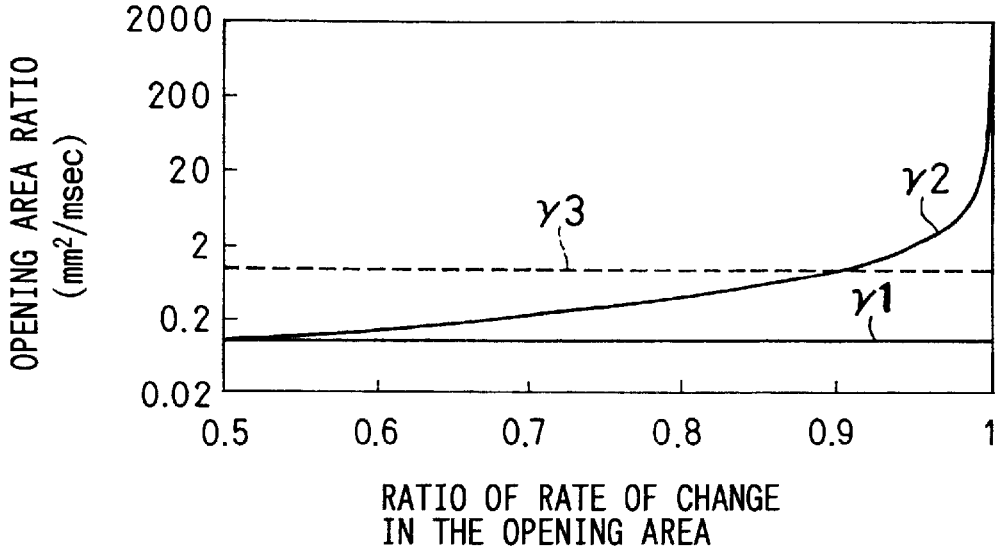
FIG. 9 is a graph showing the relationship between an opening area ratio of a discharge port and the ratio of a rate of change in opening area in a first exemplary embodiment in accordance with the present invention.

FIG. 9 is a graph in which the vertical axis designates the opening area ratio of the discharge port 35 and the horizontal axis designates the rate of change in the opening area. The solid line γ1 in FIG. 9 shows the rate of change in the opening area just before the opening area of the discharge port 35 reaches its maximum. A solid line γ2 in FIG. 9 shows the rate of change in the opening area just after the opening area of the discharge port 35 reaches its maximum. Then, a solid line γ3 in FIG. 9 shows ten times the rate of change in the opening area just before the opening area of the discharge port 35 reaches its maximum. As shown in FIG. 9, by making the opening area ratio not more than 0.95, that is, by making the area of the discharge port 35 not more than 95% of the area inside the two tip curved lines B, it is possible to reduce the ratio of the rate of change in the opening area to 20 times or less and thus to make a change in the opening area of the discharge port 35 sufficiently smooth as compared with the conventional one.

Further, by making the opening area ratio not more than 0.90, it is possible to reduce the ratio of the rate of change in the opening area to 10 times or less, and by making the opening area ratio not more than 0.65, it is possible to reduce the ratio of the rate of change in the opening area to 5 times or less. In this manner, by reducing the opening area ratio, it is possible to reduce the ratio of the rate of change in the opening area and thus to reduce the pulsation of the discharged air.

With respect to a second exemplary embodiment, the opening shape of the discharge port 35 in the second exemplary embodiment will be described with reference to FIG. 10 to FIG. 16. Here, like reference characters in the first exemplary embodiment (FIG. 1 to FIG. 9) designate like functional parts.

The inside opening shape A in the second exemplary embodiment (the opening shape of the discharge port 35 in the rotor chamber 10) is inside the two tip curved lines B drawn by the tips 1*a*, 2*a* of the pair of rotors 1, 2 when fluid starts to discharge, as is the case with the above-mentioned first exemplary embodiment, and coincides with the two tip curved lines B at least at one point.

Figure 10:
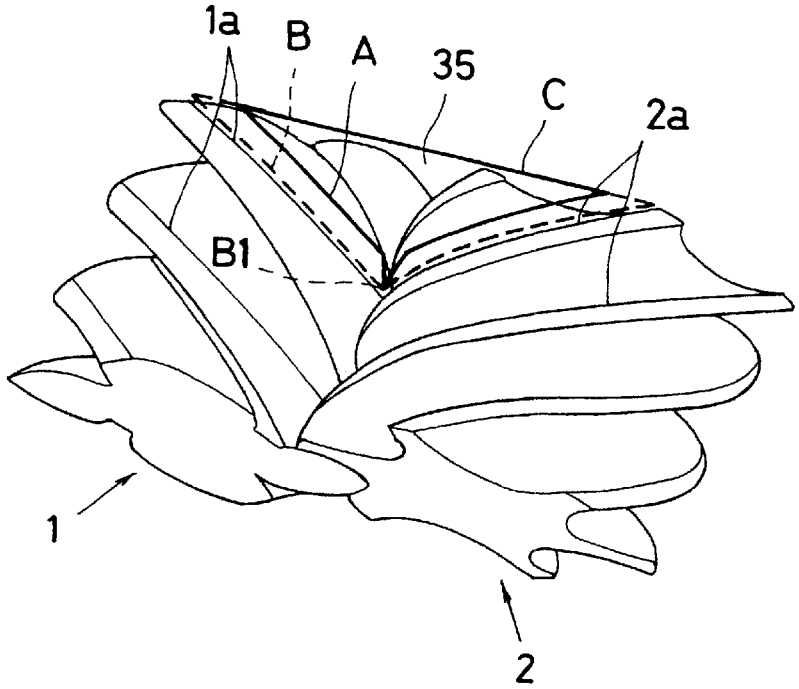
FIG. 10 is a perspective view showing a main portion of a pair of rotors of a second exemplary embodiment in accordance with the present invention.

In the inside opening shape A in the second exemplary embodiment, as shown in FIG. 10, as compared with the first exemplary embodiment, the rate of change in the distance between the points where the two tip curved lines intersect an imaginary plane perpendicular to the respective rotating shafts 14, 20 increases as the imaginary plane comes closer to the discharge side end face of the rotor chamber 10 and further is changed to 2 times or more, but preferably, 5 times or more while the rate of change increases.

The above-mentioned rate of change is changed to 2 times or more at the portions of 10% to 20% of the distance of movement in the axial direction of the two tip curved lines B from the beginning of fluid discharge to the end of discharge and the inside opening shape A is formed in 50% or less of the angle formed by the two tip curved lines B until the above-mentioned rate of change is changed to 2 times or more.

The inside opening shape A in the second exemplary embodiment is shown in FIG. 11A–FIG. 11D. The inside opening shape A in the second exemplary embodiment is formed in a polygonal shape having a vertex at the point of intersection B1 of the two tip curved lines B, a base side on a side along the discharge side end face of the rotor chamber 10, and change points D where the above-mentioned rate of change in the distance between the points where the two tip curved lines intersect the above-mentioned imaginary plane is changed to 2 times or more. In this connection, the change point D may be a bending point or may be a curved line. Specific examples are noted in the following.

In order to steadily increase the above-mentioned rate of change to the change point D, the inside opening shape A may be formed by straight lines from the point of intersection B1 to the change points D and be changed in angle at the change points D. Further, the inside opening shape A may be formed by straight lines from the point of intersection B1 to the change points D and by corners having a radius R at the change points D. Still further, in order to increase the rate of change in a quadratic function, the inside opening shape A may be formed by quadratic curves from the point of intersection B1 to the change points D. By making the inside opening shape A in this manner, in the initial stage where air compressed in the compression chamber is discharged (until the two tip curved lines B reach the change points D), the discharge opening area of the discharge port 35 increases smoothly from one point, and the area from which the air is discharged is made small, which can prevent a steep or drastic change in pressure in the initial stage of discharge.

In the middle stage of discharge (after the two tip curved lines B pass the change points D), the discharge opening area abruptly increases with the rotation of the rotors 1, 2 and thus when the discharge pressure increases as the volume of the compression chamber decreases, the discharged air sufficiently flows from the discharge port 35, which prevents an unnecessary increase in pressure. Since the discharge opening area of the discharge port 35 varying with the movement of the two tip curved lines B is changed before and after the change points D in this manner, it is possible to further reduce the pulsation of the discharged air and thus to reduce the vibration and noise of the screw compressor as compared with the first exemplary embodiment of FIG. 1 to FIG. 9.

Next, with reference to FIG. 11A to FIG. 11D, the state where the opening area of the discharge port 35 varies with time will be described.

Figure 11A:
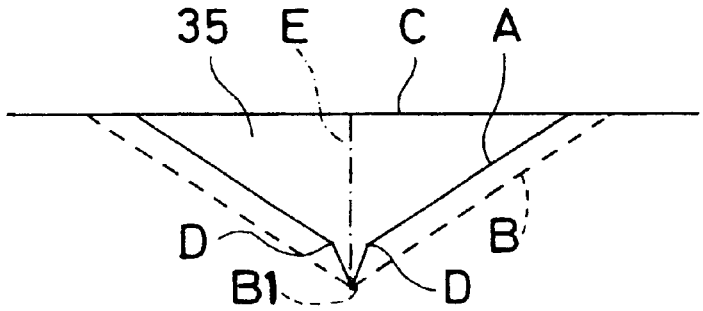
FIG. 11A is an illustration showing a shape of a discharge port of a second exemplary embodiment in accordance with the present invention.

At the instant when the rotational angle of the pair of rotors 1, 2 reaches a predetermined angle and the discharge port 35 starts to open, as shown in FIG. 11A, the opening area of the discharge port 35 is zero.

Figure 11B:
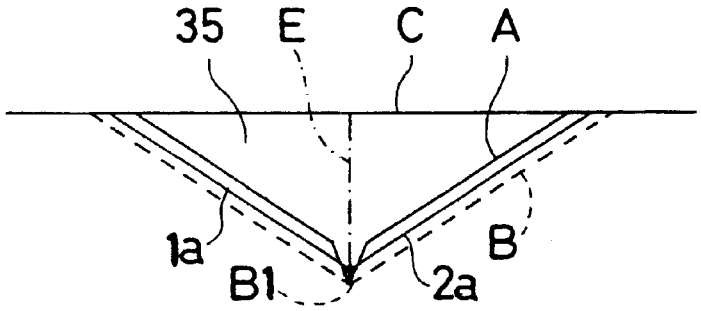
FIG. 11B is an illustration showing a shape of a discharge port of a second exemplary embodiment in accordance with the present invention.

From this time to the time when the rotors 1, 2 rotate and the two tip curved lines B reach the change points D, as shown in FIG. 11B, the opening area (portion shown by hatch lines) increases little by little.

Figure 11C:
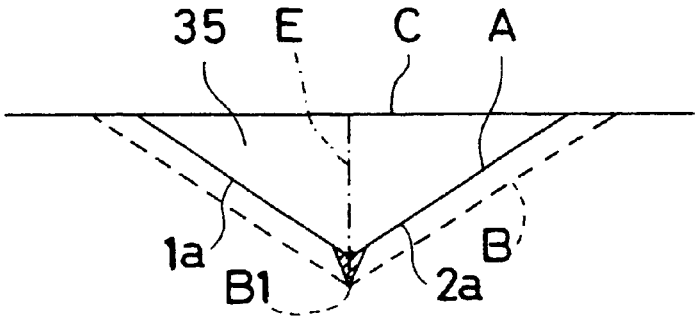
FIG. 11C is an illustration showing a shape of a discharge port of a second exemplary embodiment in accordance with the present invention.
Figure 11D:
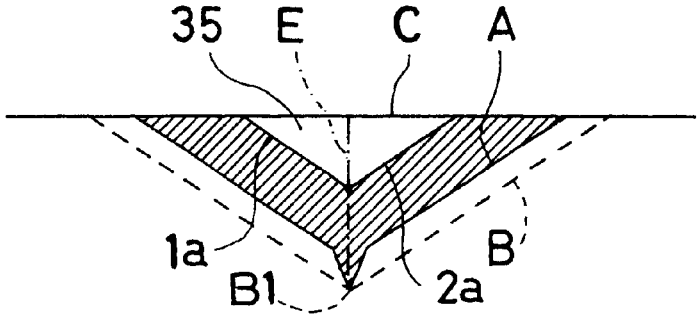
FIG. 11D is an illustration showing a shape of a discharge port of a second exemplary embodiment in accordance with the present invention.

When the rotors 1, 2 rotate further and the two tip curved lines B reach the change points D, as shown in FIG. 11C, the rate of change in the opening area is changed. Then, after the two tip curved lines B pass the change points D, as shown in FIG. 11D, the opening area quickly increases in response to the rotation of the rotors 1, 2. In this connection, line E in FIG. 11A–FIG. 11D designate the path of the points of intersection B1 of the two tip curved lines B and the distance of movement in the axial direction of the two tip curved lines B.

Next, the second exemplary embodiment will be described by the use of a comparative example.

Figure 12A:
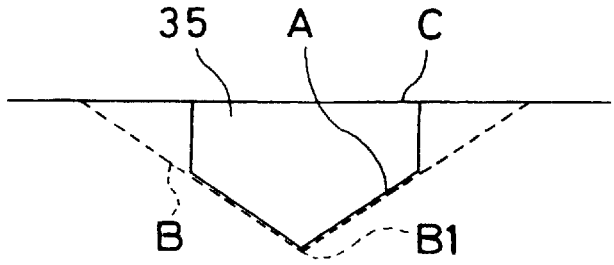
FIG. 12A is an illustration showing the shape of a discharge port of a comparative example.
Figure 12B:
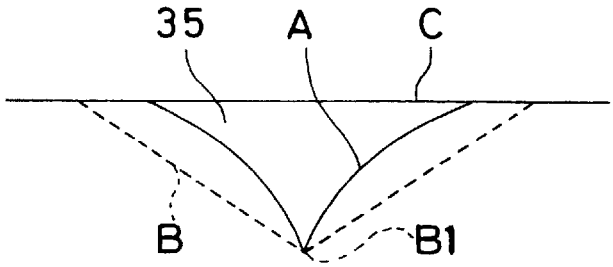
FIG. 12B is an illustration showing the shape of a discharge port of a comparative example.

The comparative examples are shown in FIGS. 12A and 12B. In these comparative examples, as is the case with the above-mentioned first exemplary embodiment, the inside opening shape A of the discharge port 35 is inside the two tip curved lines B when the fluid starts to discharge. To be more specific, the inside opening shape A in FIG. 12A, the discharge opening area, increases more so from the initial stage of discharge (but smaller than the conventional one). The inside opening shape A in FIG. 12B corresponds to FIG. 6A in the first exemplary embodiment.

Figure 13:
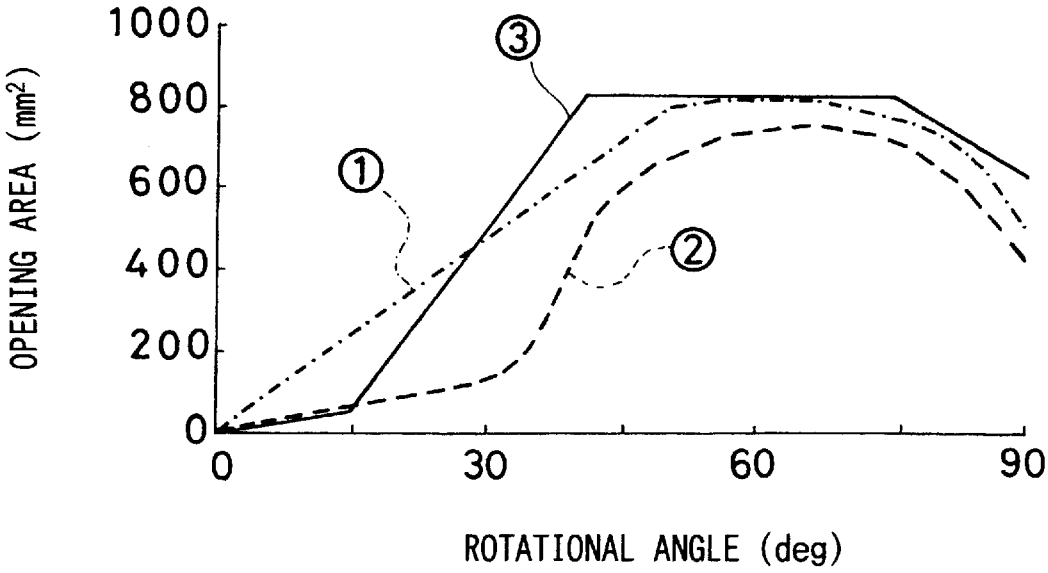
FIG. 13 is a graph showing the relationship between a rotational angle of a main shaft and an opening area from the beginning of the opening of a discharge port to the end of the opening of the discharge port in the case where the shape of the discharge port is varied in the second exemplary embodiment in accordance with the present invention.
Figure 14:
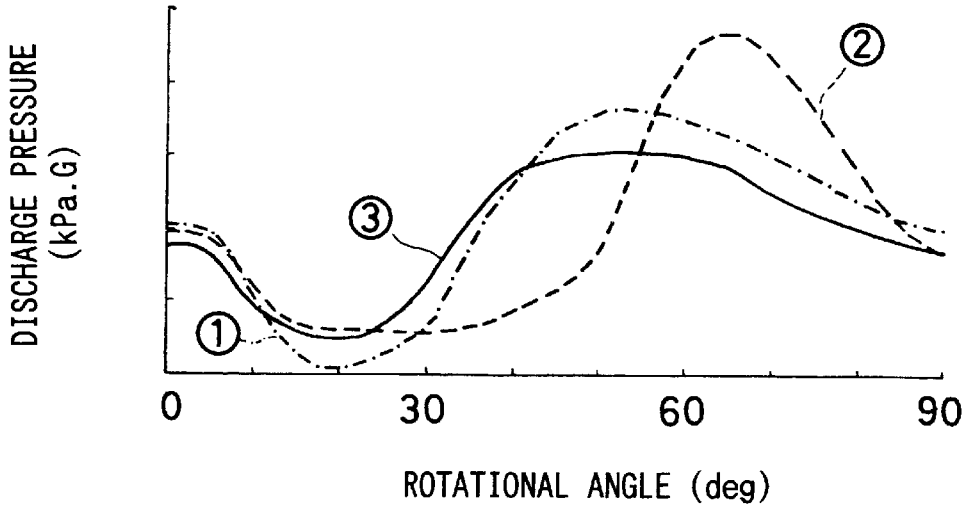
FIG. 14 is a graph showing the relationship between a rotational angle of a main shaft and a discharge pressure from the beginning of the opening of a discharge port to the end of discharge in the case where the shape of the discharge port is varied in the second exemplary embodiment in accordance with the present invention.

A change in the opening area in the inside opening shape A in FIG. 12A is shown by line ① in FIG. 13. As shown by line ① in FIG. 13, the inside opening shape A in FIG. 12A has a comparatively large discharge opening area from the initial stage of discharge. For this reason, as shown by line ① in FIG. 14, the discharge pressure is low (in comparison) in the initial stage of discharge thereby causing pulsation of the discharged air.

A change in the opening area in the inside opening shape A in FIG. 12B corresponds to line ② in FIG. 13. As shown by line ② in FIG. 13, the inside opening shape A in FIG. 12B, the discharge opening area in the middle stage of discharge is not sufficiently large. For this reason, as shown by line ② in FIG. 14, the discharge pressure increases in the middle stage of discharge, thereby causing pulsation of the discharged air. A change in the opening area at the discharge port 35 corresponding to the inside opening shape A in FIG. 11 (second exemplary embodiment) is shown by line ③ in FIG. 13.

As shown by line ③ in FIG. 13, since the rate of increase in the discharge opening area in the initial stage of discharge is small as in the inside opening shape A in FIG. 12B, a decrease in the discharge pressure in the initial stage of discharge can be prevented, and since the discharge opening area in the middle stage of discharge is sufficiently large, an increase in the discharge pressure can be prevented. For this reason, as shown by line ③ in FIG. 14, the pulsation of the discharged air can be reduced to a low level.

The reason will be described why the change points D where the above-mentioned rate of change is changed to 2 times or more are set at the positions of 10% to 20% of the distance which the two tip curved lines B move in the axial direction between the instant when the fluid starts discharging and the instant when the fluid finishes discharging. In the case where an increase in the opening area is not prevented in the initial stage of discharge, that is, in the case corresponding to FIG. 12A, as shown by line ① in FIG. 14, the discharge pressure abruptly decreases in the initial stage of discharge. The region where the discharge pressure abruptly decreases is the region corresponding to 10% to 20% of the distance which the two tip curved lines B move in the axial direction between the instant when the fluid starts discharging and the instant when the fluid finishes discharging. For this reason, in order to prevent an abrupt decrease in the discharge pressure, the region where an increase in the opening area is to be prevented is set at the region of 10% to 20% of the distance which the two tip curved lines B move in the axial direction between the instant when the fluid starts discharging and the instant when the fluid finishes discharging.

Figure 15:
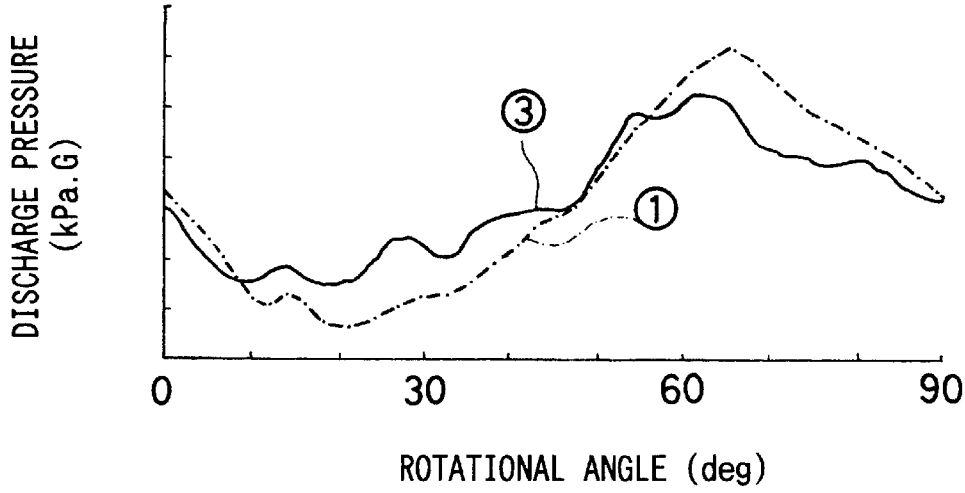
FIG. 15 is a graph showing the relationship between the rotational angle of a main shaft and the measured value of a discharge pressure in a discharge space from the opening of a discharge port to the end of discharge in the case where the shape of the discharge port is varied in the second exemplary embodiment in accordance with the present invention.

The measured value of the pressure of the air discharged from the screw compressor having the inside opening shape A in FIG. 12A are shown by line ① in FIG. 15. The measured values of the pressure of the air discharged from the screw compressor having the inside opening shape A in FIG. 11A–11D (second exemplary embodiment) are shown by line ③ in FIG. 15.

As shown in FIG. 15, in the second exemplary embodiment, the rate of pulsation of the discharge pressure can be reduced 30% or more at the maximum as compared to the comparative example in FIG. 12A in which the inside opening shape A of the discharge port 35 is formed simply inside the two tip curved lines B at the instant when the fluid starts to discharge.

Next, a modification of the second embodiment of the inside opening shape A in which the rate of increase in the opening area is changed to 2 times or more in the initial stage of discharge will be described with reference to FIG. 16A to FIG. 16D.

Figure 16A:
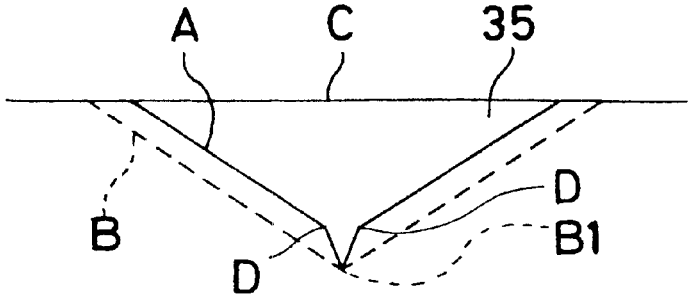
FIG. 16A is an illustration showing the shape of the discharge port in a modification of the second exemplary embodiment in accordance with the present invention.

The inside opening shape A shown in FIG. 16A has straight lines extending from the point of intersection B1 to the change points D and straight lines extending from the change points D to the base side C. In this manner, forming the inside opening shape A only by straight lines, it is possible to easily make the inside opening shape A and to reduce manufacturing costs.

Figure 16B:
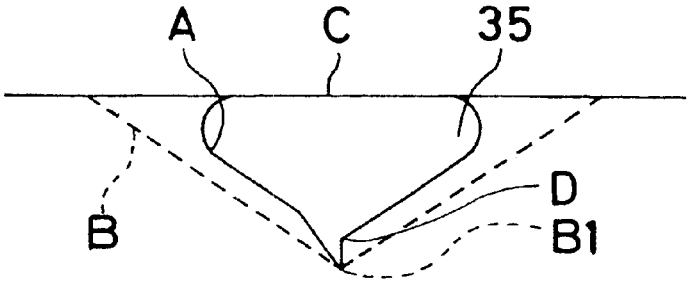
FIG. 16B is an illustration showing the shape of the discharge port in a modification of the second exemplary embodiment in accordance with the present invention.

In the inside opening shape A shown in FIG. 16B, the above-mentioned rate of change of the opening area is increased by changing the moving path of only one tip curved line of the two tip curved lines B (only the tip curved line of one of the rotors 1, 2) from the point of intersection B1 to the change point D.

In this manner, the tip curved line of one of the rotors 1, 2 gradually widens the opening area ahead of the other tip curved line while communicating with the discharge port 35. Therefore, it is possible to prevent a steep or drastic change in the discharge pressure when the fluid begins to discharge. Further, it is possible to reduce the pulsation of the discharged air because the timing of discharge by the rotors 1, 2 is shifted.

Figure 16C:
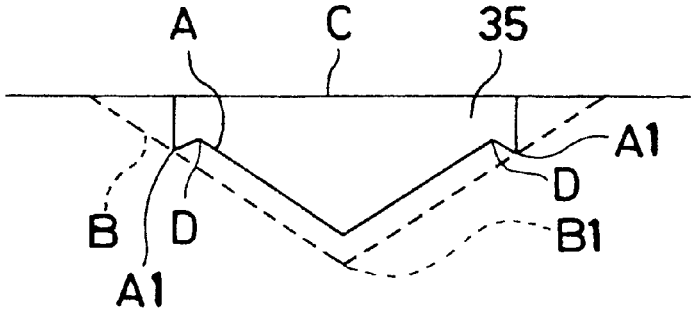
FIG. 16C is an illustration showing the shape of the discharge port in a modification of the second exemplary embodiment in accordance with the present invention.

In the inside opening shape A shown in FIG. 16C, the opening area is increased from discharge starting points A1, each of which has a vertex in the middle of each of the two tip curved lines B. Although a strong stream is produced in the center of the groove formed by the rotors 1, 2 with the rotation of the rotors 1, 2, by the adoption of such an inside opening shape A, it is possible to increase the discharge opening area at a portion other than the stream flow. This prevents an abrupt change in discharge pressure when the air starts to discharge.

Figure 16D:
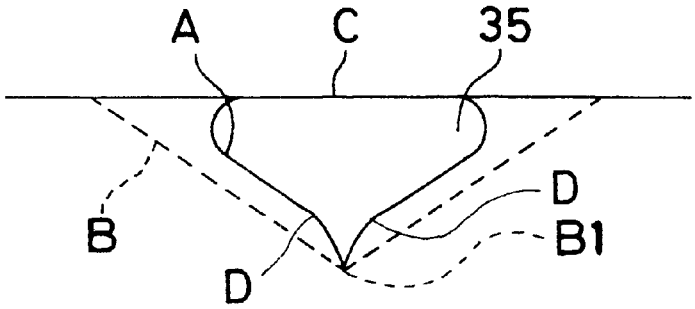
FIG. 16D is an illustration showing the shape of the discharge port in a modification of the second exemplary embodiment in accordance with the present invention.

In the inside opening shape A shown in FIG. 16D, the rate of change in the distance between the points where both curved lines forming the inside opening shape A intersect an imaginary plane perpendicular to the rotating shafts of the rotors 1, 2 again reduces near the discharge side, and the positions where the rate of change starts to decrease are provided at locations corresponding 70% to 80% of the distance of movement in the axial direction of the two tip curved lines B. This configuration prevents an abrupt decrease in the discharge pressure when the air finishes discharging and thus can further reduce the pulsation of the discharged air.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A screw compressor comprising:

a pair of rotors and a pair of shafts, the pair of rotors engaging each other;

a casing provided with a rotor chamber for receiving the pair of rotors; and a discharge port communicating with the rotor chamber and for discharging fluid compressed by the pair of rotors to an outside of the rotor chamber, wherein:

an opening shape of the discharge port in the rotor chamber is inside two tip curved lines defined by tips of the pair of rotors and coincides with the two tip curved lines at least at one point when the fluid starts to discharge from the discharge port; and the discharge port in the casing defines an inside cross-section which is unchanged in the discharge direction.

2. A screw compressor according to claim 1, wherein the opening shape of the discharge port in the rotor chamber is formed in a polygonal shape having a vertex on at least one of the two tip curved lines and one side of the discharge side end face of the rotor chamber.

3. A screw compressor according to claim 1, wherein the opening area of the discharge port in the rotor chamber is set at 95% or less of an area surrounded by the two tip curved lines and a discharge side end face of the rotor chamber.

4. A screw compressor according to claim 1, wherein the opening area of the discharge port in the rotor chamber is set at 90% or less of an area surrounded by the two tip curved lines and a discharge side end face of the rotor chamber.

5. A screw compressor according to claim 1, wherein the opening area of the discharge port in the rotor chamber is set at 65% or less of an area surrounded by the two tip curved lines and a discharge side end face of the rotor chamber.

6. A screw compressor according to claim 1, wherein a vertical angle at the discharge starting side of the discharge port in the rotor chamber is set at 95% or less of a vertical angle formed by the two tip curved lines at a discharge starting side.

7. A screw compressor comprising:

a pair of rotors and a pair of shafts, the pair of rotors engaging each other;

a casing provided with a rotor chamber for receiving the pair of rotors; and a discharge port communicating with the rotor chamber and for discharging fluid compressed by the pair of rotors to an outside of the rotor chamber, wherein:

an opening shape of the discharge port in the rotor chamber is inside two tip curved lines defined by tips of the pair of rotors and coincides with the two tip curved lines at least at one point when the fluid starts to discharge from the discharge port;

the discharge port in the casing defines an inside cross-section which is unchanged in the discharge direction; and the inside opening cross-section of the discharge port is triangular with a vertex that is at a location where the discharge port starts opening and on one curved line of the two tip curved lines.

* * * * *